US010264938B2

(12) United States Patent
Ichikawa et al.

(10) Patent No.: US 10,264,938 B2
(45) Date of Patent: Apr. 23, 2019

(54) VACUUM CLEANER

(71) Applicant: TOSHIBA LIFESTYLE PRODUCTS & SERVICES CORPORATION, Kawasaki-shi (JP)

(72) Inventors: Hiromitsu Ichikawa, Owariasahi (JP); Masatoshi Tanaka, Seto (JP); Hiromitsu Murata, Kasugai (JP); Atsushi Morishita, Hadano (JP); Yukio Machida, Owariasahi (JP)

(73) Assignee: TOSHIBA LIFESTYLE PRODUCTS & SERVICES CORPORATION, Kawasaki-shi (JP)

( * ) Notice: Subject to any disclaimer, the term of this patent is extended or adjusted under 35 U.S.C. 154(b) by 134 days.

(21) Appl. No.: 15/304,899

(22) PCT Filed: Apr. 22, 2015

(86) PCT No.: PCT/JP2015/062262
§ 371 (c)(1),
(2) Date: Oct. 18, 2016

(87) PCT Pub. No.: WO2015/163372
PCT Pub. Date: Oct. 29, 2015

(65) Prior Publication Data

US 2017/0181593 A1 Jun. 29, 2017

(30) Foreign Application Priority Data

Apr. 22, 2014 (JP) ..... 2014-088360

(51) Int. Cl.

| | |
|---|---|
| ***A47L 9/04*** | (2006.01) |
| ***A47L 9/00*** | (2006.01) |
| ***A47L 9/28*** | (2006.01) |

(52) U.S. Cl.
CPC ..... *A47L 9/2852* (2013.01); *A47L 9/009* (2013.01); *A47L 9/04* (2013.01); *A47L 9/0477* (2013.01);
(Continued)

(58) Field of Classification Search
CPC .... A47L 9/2852; A47L 9/2842; A47L 9/2857; A47L 9/2889; A47L 9/009; A47L 9/0477;
(Continued)

(56) References Cited

U.S. PATENT DOCUMENTS

| | | | | |
|---|---|---|---|---|
| 2013/0291331 | A1 | 11/2013 | Yang et al. | |
| 2014/0067116 | A1 | 3/2014 | Moon et al. | |
| 2014/0109935 | A1* | 4/2014 | Jang | A47L 11/4011 134/18 |

FOREIGN PATENT DOCUMENTS

| | | | |
|---|---|---|---|
| CN | 103315677 | A | 9/2013 |
| CN | 203493563 | U | 3/2014 |

(Continued)

OTHER PUBLICATIONS

Translation JP2011/45694.*

(Continued)

*Primary Examiner* — Robert J Scruggs
(74) *Attorney, Agent, or Firm* — Oblon, McClelland, Maier & Neustadt, L.L.P.

(57) ABSTRACT

A vacuum cleaner includes a main casing, driving wheels, side brushes, an obstacle sensor, and a controller. The driving wheels enable the main casing to travel. The side brushes are reciprocatively movable in both a direction of protruding from an outer frame of the main casing and its opposite direction, enabling cleaning of dust and dirt located outside the outer frame of the main casing. The obstacle sensor detects an obstacle by detecting a movement of the side brush in the opposite direction due to its contact with (Continued)

the obstacle. The controller controls drive of the driving wheels based on detection of an obstacle by the obstacle sensor to make the main casing autonomously travel. The vacuum cleaner can detect an obstacle at a position of a side brush while securely cleaning dust and dirt located outside an outer frame of a main casing by the side brush.

2 Claims, 9 Drawing Sheets

(52) U.S. Cl.
CPC ..... *A47L 9/28* (2013.01); *A47L 9/2805* (2013.01); *A47L 2201/04* (2013.01)

(58) Field of Classification Search
CPC . A47L 9/2805; A47L 2201/04; A47L 2201/00
See application file for complete search history.

(56) References Cited

FOREIGN PATENT DOCUMENTS

| | | | |
|---|---|---|---|
| EP | 0 424 229 | A1 | 4/1991 |
| EP | 0 424 229 | B1 | 6/1994 |
| JP | 62-292124 | A | 12/1987 |
| JP | 4-96720 | A | 3/1992 |
| JP | 4-328607 | | 11/1992 |
| JP | 2003-190064 | A | 7/2003 |
| JP | 2004-49592 | | 2/2004 |
| JP | 2004-49593 | A | 2/2004 |
| JP | 2011-45694 | A | 3/2011 |
| JP | 2013-81775 | A | 5/2013 |
| JP | 2013-85958 | A | 5/2013 |
| JP | 2013-89256 | A | 5/2013 |
| JP | 2014-30770 | A | 2/2014 |
| JP | 2014-46207 | A | 3/2014 |
| WO | 2013/051843 | A1 | 4/2013 |

OTHER PUBLICATIONS

Translation JP4-96720.*
International Search Report dated Jul. 21, 2015 in PCT/JP15/062262 Filed Apr. 22, 2015.
Office Action dated Sep. 29, 2017 in Korean Patent Application No. 10-2016-7008343.

* cited by examiner

VACUUM CLEANER

CROSS REFERENCE TO RELATED APPLICATIONS

The present application is a National Stage Application of PCT/JP2015/062262 filed on Apr. 22, 2015. The PCT application claims priority to Japanese Patent Application No. 2014-88360 filed on Apr. 22, 2014. All of the above applications are herein incorporated by reference in their entirety.

FIELD

Embodiments described herein relate generally to a vacuum cleaner including a cleaning unit capable of cleaning dust and dirt located outside an outer frame of the cleaner main casing.

BACKGROUND

Conventionally, there has been known a so-called autonomous-traveling type vacuum cleaner (cleaning robot) which cleans a surface to be cleaned while autonomously traveling on the surface. Such a vacuum cleaner, including a sensor for detecting an obstacle by making contact (colliding) with the obstacle, is under travel control so as to avoid a detected obstacle.

With such a vacuum cleaner as described above, which requires spaces for setting traveling-use driving wheels on both sides of a suction port in a lower portion of the main casing, it is difficult to design a large width of the suction port. Therefore, a cleaning unit such as side brushes is provided so that dust and dirt can be removed over a larger width. In this case, with the side brushes protruding to the side of the main casing, a sensor for detecting an obstacle by such contact as described above cannot be provided at a position of the cleaning unit, giving rise to positions where obstacle detection cannot be achieved. With the side brushes positioned so as not to protrude from the main casing, there arises a difficulty for the side brushes to reach outward of the outer frame of the main casing so that wall proximities or the like cannot be cleaned securely.

CITATION LIST

Patent Literature

PTL 1: Japanese Laid-open Patent Publication No. 2013-89256

PTL 2: Japanese Laid-open Patent Publication No. 2014-30770

SUMMARY OF INVENTION

An object of this invention is, therefore, to provide a vacuum cleaner enabled to detect any obstacle at the position of its cleaning unit while cleaning dust and dirt located outside the outer frame of the main casing securely with the cleaning unit.

Solution to Problem

In order to solve the problem, a vacuum cleaner according to an embodiment of the present invention includes a main casing, driving wheels, a cleaning unit, an obstacle detection unit, and a control unit. The driving wheels enable the main casing to travel. The cleaning unit is provided so as to be reciprocatively movable in both a direction protruding from the outer frame of the main casing and its opposite direction, thus being able to clean dust and dirt located outside the outer frame of the main casing. The obstacle detection unit detects an obstacle by detecting a movement of the cleaning unit in the opposite direction due to its contact with the obstacle. The control unit controls drive of the driving wheels based on detection of an obstacle by the obstacle detection unit so that the main casing travels autonomously.

DETAILED DESCRIPTION

Hereinbelow, an embodiment of the invention will be described in terms of its constitution with reference to FIGS. 1A, 1B to 10.

Figure 9:
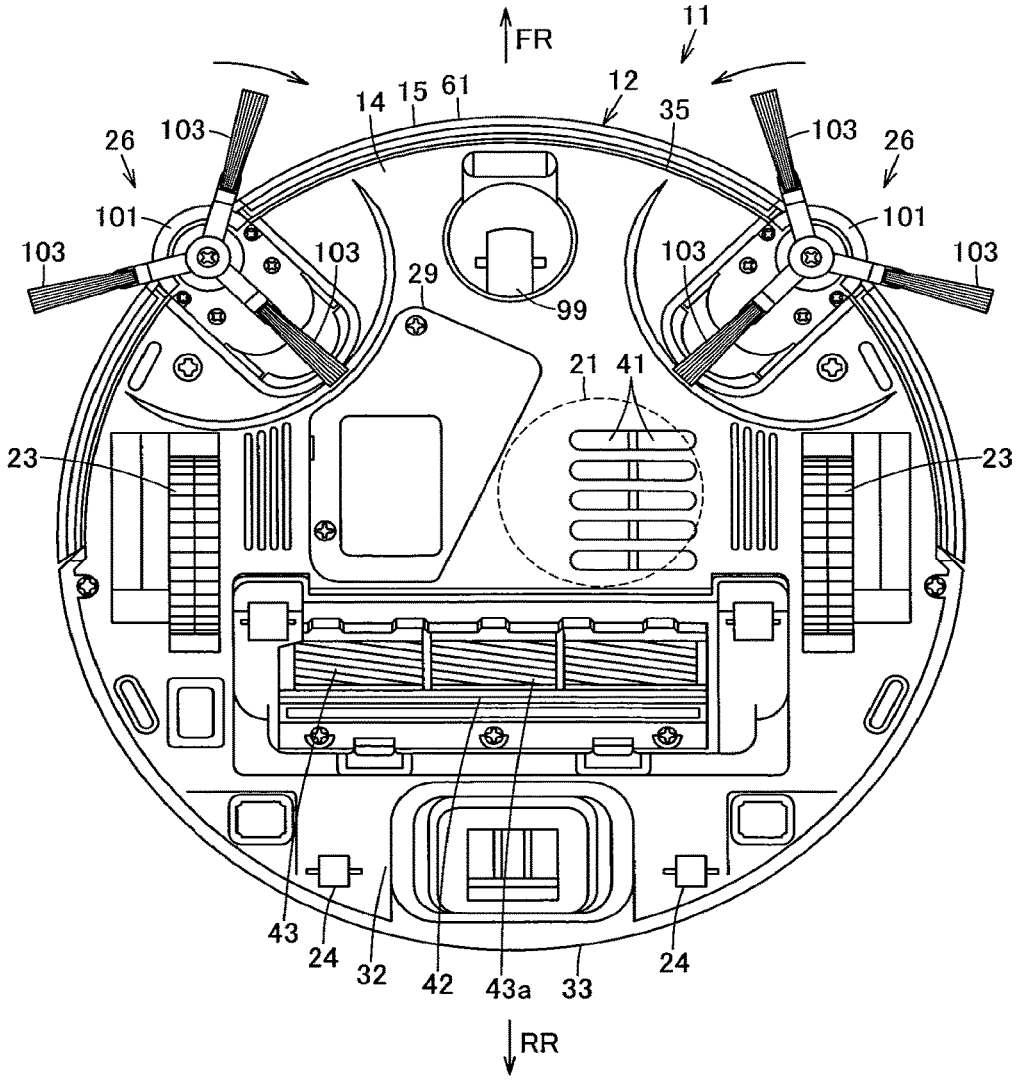
FIG. 9 is a plan view showing the vacuum cleaner from below.
Figure 10:
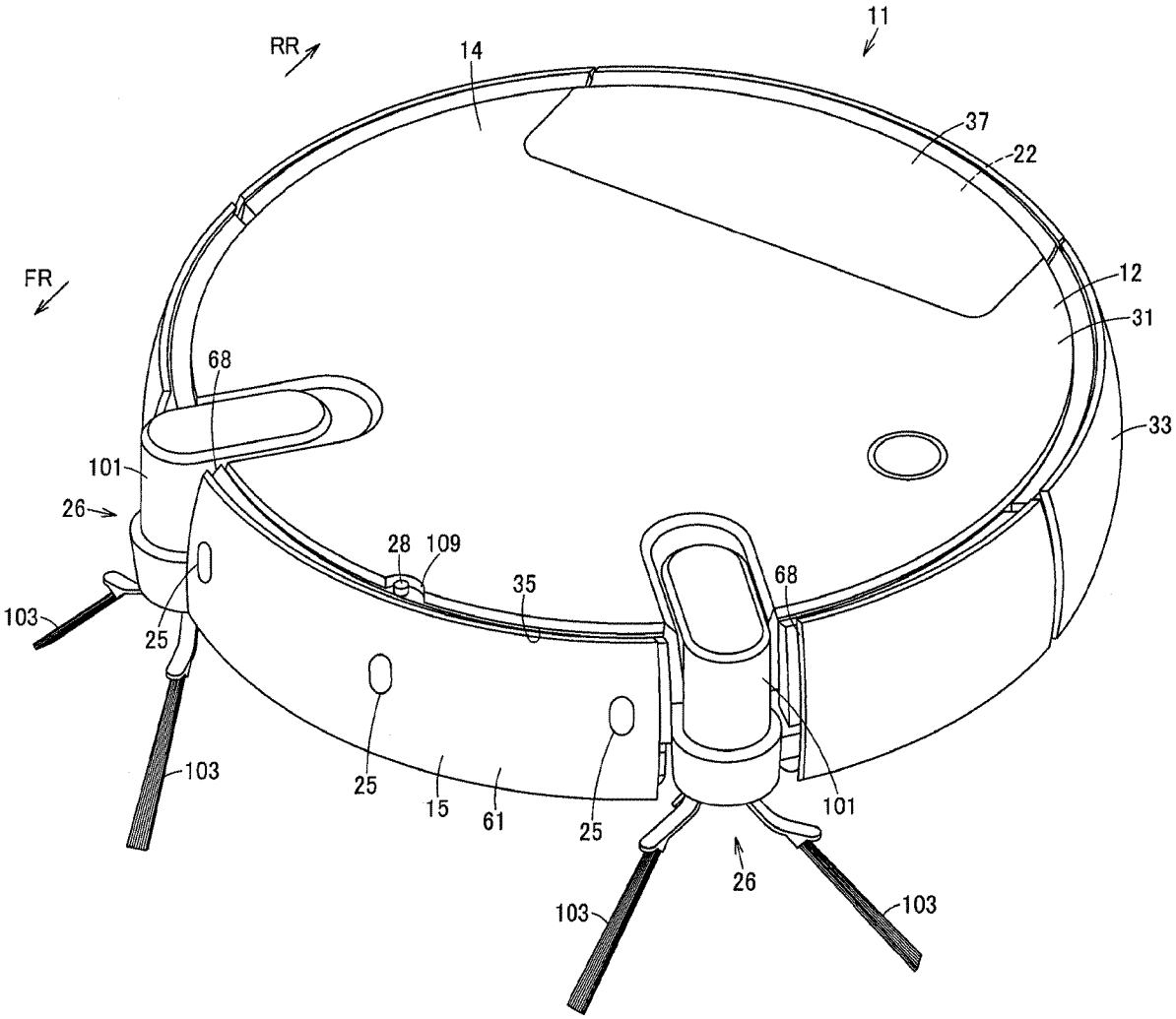
FIG. 10 is a perspective view of the vacuum cleaner.

In FIGS. 9 and 10, reference sign 11 denotes a vacuum cleaner. This vacuum cleaner 11, in this embodiment, will be described hereinbelow as a vacuum cleaner 11 exemplified by a so-called self-propelled robot cleaner that, while autonomously traveling (self-propelled to run) on a surface to be cleaned (floor surface), cleans the surface to be cleaned.

Figure 7:
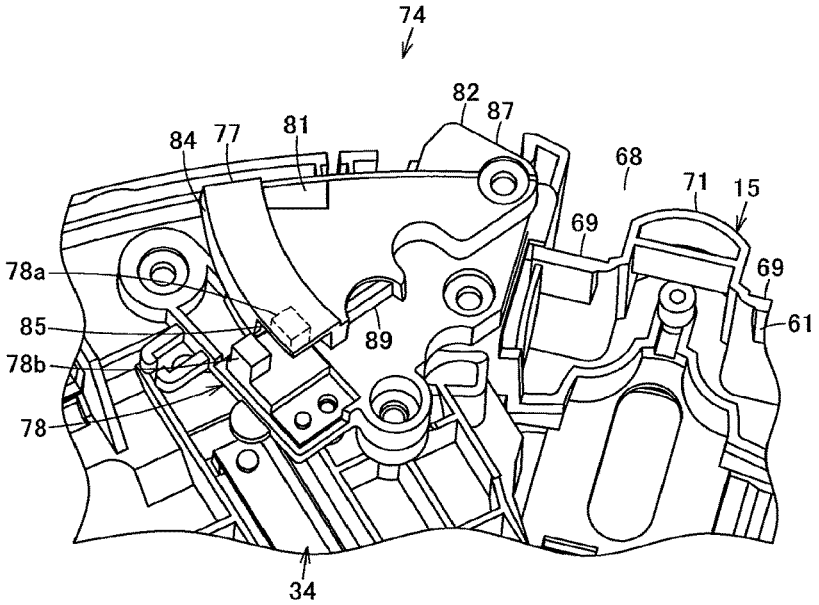
FIG. 7 is a perspective view showing an obstacle detection unit of the vacuum cleaner from below.
Figure 8:
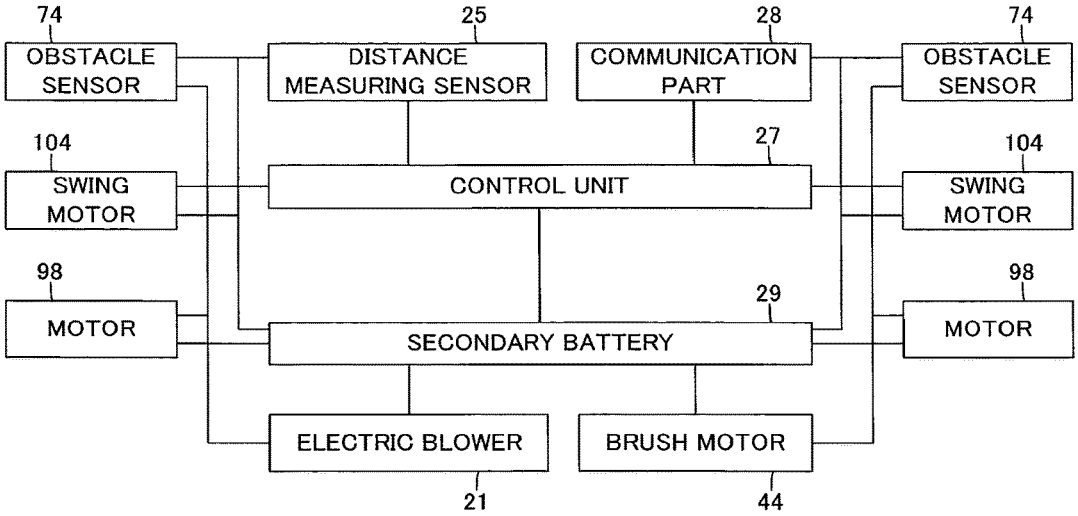
FIG. 8 is a block diagram showing an internal structure of the vacuum cleaner.

The vacuum cleaner 11 includes a hollow main casing 12, which is so constructed that a casing body 14 as a main body part and a bumper 15 serving as a cushion member placed on an outer rim portion of the casing body 14 to form part of the outer frame (outer circumferential surface) of the main casing 12 are movably connected to each other via paired (a pair of) link mechanisms 16, 16, the main casing 12 thus being formed into a flat columnar shape (disc shape) or the like as a whole. In the main casing 12, an electric blower 21 is housed in the casing body 14 and moreover a dust collector unit 22 communicating with the suction side of the electric blower 21 is removably provided rearward, as an example. Further provided in this main casing 12 are, for example, driving wheels 23 as a plurality (one pair) of driving parts, a plurality of driven wheels 24, distance measuring sensors 25 as a plurality of distance detection means (distance detection parts), side brushes 26, 26 being swinging cleaning units as a pair of cleaning units, a control unit (control means) 27 composed of a circuit board and the like, a communication part 28 for radio communications with external devices, and a secondary battery 29 as a battery forming a power source unit. In addition, the following description will be given on the assumptions that a direction extending along the traveling direction of the vacuum cleaner 11 (main casing 12) is assumed as a back-and-forth direction (directions of arrows FR and RR shown in FIG. 9 etc.) while a left-and-right direction (directions toward both sides) crossing (orthogonally intersecting) with the back-and-forth direction is assumed as a widthwise direction, and a state where the vacuum cleaner 11 is placed on a flat surface to be cleaned is assumed as a standard state. Further, FIGS. 1 and 7 show only one side (right side) of the vacuum cleaner 11, where the other side (left side) is omitted in depiction because the vacuum cleaner 11 is formed substantially in line symmetry along the widthwise direction.

The casing body 14 has its external surfaces substantially covered by an upper surface 31, which is a decorative sheet formed from a hard synthetic resin as an example, a lower surface 32, which is a decorative sheet, and a rearward outer circumferential surface 33, which is a decorative sheet as a main-body outer side surface (outer side surface of the casing body). A structure section 34 composed of a plurality of casing members is formed in the interior surrounded by the upper surface 31, lower surface 32 and rearward outer circumferential surface 33. Then, a portion of the casing body 14 ranging from both sides to the front side is formed into a circular-arc shaped opening 35 into which the bumper 15 is fitted.

The upper surface 31 serving as the upper surface of the main casing 12 is formed into a flat plate which is circular-shaped as in a plan view and which extends along a horizontal direction. A dust collector unit cover part 37 to be opened and closed for fitting and removal of the dust collector unit 22 is provided in a rear portion of the upper surface 31.

The lower surface 32, serving as the lower surface of the main casing 12, is formed into a flat plate which is circular-shaped as in a plan view and which extends along a horizontal direction. Opened in this lower surface 32 are a plurality of exhaust ports 41 for discharging exhaust air from the electric blower 21 and a suction port 42 serving as a dust collecting port communicating with the dust collector unit 22, while driving wheels 23, 23 are placed at rather forward positions on both sides of the suction port 42. A rotary brush 43 as a rotary cleaner member is rotatably fitted to the suction port 42. The rotary brush 43, in which a cleaning member 43*a* such as a bristle brush or a blade is placed on the outer circumferential surface, is rotated by a brush motor 44 (FIG. 8) as a rotation driving means (rotation driving part) so that the cleaning member 43*a* repeatedly contacts the surface to be cleaned to scrape up dust and dirt on the surface to be cleaned.

The rearward outer circumferential surface 33 forms a portion of the casing body 14 ranging from its both sides to its rear side, i.e., a substantially rear-half outer circumferential surface (outer frame) of the main casing 12. The rearward outer circumferential surface 33 is formed into a semicircular-arc cylindrical-surface shape having an axial direction along the vertical up/down direction and set to a specified diameter size so as to be positioned in continuation to the upper surface 31 and the lower surface 32.

The structure section 34 is a part that is basically housed inside of the main casing 12 without being exposed to the outside thereof. Cylindrical-shaped (boss-shaped) pivotal support parts 51, 51 as main body-side pivotal support parts forming portions of the link mechanisms 16, 16, and a bias receiving part 52 located between those pivotal support parts 51, 51, are formed in the fore end portion of the structure section 34. Also, guide portions 53 for guiding the individual side brushes 26, respectively, along the radial direction of the main casing 12 (casing body 14) are formed in the structure section 34.

The pivotal support parts 51, 51 are placed apart from each other at positions of substantial line symmetry with respect to a widthwise center line L of the structure section 34 (main casing 12 (casing body 14)). The pivotal support parts 51, 51 are provided so as to protrude vertically upward from an upper portion of the structure section 34 facing a lower portion of the upper surface 31.

The bias receiving part 52 is a part which receives and holds a rear end portion of a coil spring 55 serving as a bumper biasing means (bumper biaser) for biasing the bumper 15 forward in a going-out direction against the casing body 14 (direction of separating from the casing body 14) at a position between the link mechanisms 16, 16 to return the bumper 15 to its normal position. The bias receiving part 52 is located at a position overlapping with the widthwise center line L of the structure section 34 (main casing 12 (casing body 14)), i.e., at a widthwise center portion of the structure section 34 (main casing 12 (casing body 14)).

The guide portions 53 guide the side brushes 26, 26 so that the side brushes 26, 26 can be reciprocatively moved in their protruding direction and reverse direction against the main casing 12. The guide portions 53 also serve as stoppers for the side brushes 26, 26 that are in their maximally protruding state against the main casing 12. The guide portions 53 are formed, for example, at positions on widthwise both sides of the structure section 34 (main casing 12 (casing body 14)), and in this embodiment, on oblique both sides of the main casing 12 forward of its center portion in the back-and-forth direction (forward of the main casing 12 in left-and-right 45° directions). It is noted that herein, a direction in which the side brushes 26 protrude from the outer frame of the main casing 12 is referred to as a protruding direction and its reverse direction is referred to as a withdrawal direction.

Meanwhile, as shown in FIGS. 1A, 1B to 6, FIGS. 9 and 10 and the like, the bumper 15, which is intended to elastically reduce impacts upon contact (collisions) with an obstacle W or the like, is formed from a rigid synthetic resin (rigid material) as an example. The bumper 15 includes a cylindrical-surface-like curved bumper body 61 forming a part of the main casing 12 ranging from its both sides to its front side, i.e., a substantially front-half outer circumferential surface (outer frame) of the main casing 12, a plate-shaped extension part 62 extended rearward from an upper end portion of the bumper body 61, bumper-side pivotal support parts 63, 63 protrusively provided in the bumper body 61 and forming portions of the link mechanisms 16, 16, a bumper-side bias receiving part 64 provided in the bumper body 61 between the bumper-side pivotal support parts 63, 63, and a side lever 65 provided in the bumper body 61. Then, the bumper 15 is fitted into the opening 35 of the casing body 14 so as to be reciprocatively movable along the radial direction of the casing body 14.

The bumper body 61, having its axial direction along the vertical up/down direction, is formed into a semicircular-arc shape extending along a circular arc equal in diameter to the rearward outer circumferential surface 33. While being in a normal position, where the obstacle W or the like is not in contact with the bumper (i.e., no load is applied thereto), the bumper body 61 forms a substantial one cylindrical surface (substantial one circle as in a plan view) in combination with the rearward outer circumferential surface 33. Accordingly, the rearward outer circumferential surface 33 and the bumper body 61 constitute the outer circumferential surface of the main casing 12. Also, the bumper body 61 is radially separated from an outer rim portion of the casing body 14 ranging from its both sides to its front side with a specified gap therebetween, where the gap equals a maximum stroke to which the bumper 15 is reciprocatively movable. Further, in the bumper body 61, brush fitting portions 68, 68 as cleaning-unit fitting portions into which the side brushes 26, 26 are to be fitted are radially recessed at positions corresponding to the individual guide portions 53, respectively, of the structure section 34. Moreover, contact portions 69, 69 are provided so as to be positioned inside the brush fitting portions 68, respectively, and contactable with the side brushes 26, respectively. Then, protruding portions 70, 70 serving as presser portions are protrusively provided in the bumper body 61 on its inner surface facing the casing body 14.

Each of the brush fitting portions 68 is formed so as to be recessed toward the inner circumferential side against an enveloping surface, which is an imaginary circular-arc surface containing the outer circumferential surface serving as the outer frame of the bumper body 61 (bumper 15).

Based on contact with the side brushes 26 that have been moved by a specified extent or more in the withdrawal direction against the main casing 12, the contact portions 69 make the side brushes 26 and the bumper 15 reciprocatively moved in linkage with each other.

The protruding portions 70 have contact surfaces 73, respectively, each formed into a sloped flat surface. The contact surfaces 73 are normally kept in contact with obstacle sensors 74 that are obstacle detection means (obstacle detection units) provided on the casing body 14 (structure section 34) in the normal position of the bumper 15, thus making the obstacle sensors 74 operate. Also, near the brush fitting portions 68, the protruding portions 70 are placed each at a position on one side of the brush fitting portion 68 closer to the center line L.

Each contact surface 73 is protruded from the inner surface of the bumper body 61 in such a manner that the protruding extent toward the center axis side (rear side) of the bumper body 61 increases more and more with increasing distance from the center line L. That is, each contact surface 73 in its planar direction has a vector component extending along the back-and-forth direction and a vector component extending along the left-and-right direction. In other words, each contact surface 73 is sloped along directions crossing with the back-and-forth direction and the left-and-right direction, respectively. Therefore, the contact surfaces 73, 73 are each sloped in an inverted-V shape as viewed from above. Also, each contact surface 73 is placed with its plane facing the center line L side.

As shown in FIGS. 1A and 1B to FIG. 4, FIG. 5A, FIG. 5B and FIG. 7, by movements of the bumper 15 and the side brushes 26, 26 in the withdrawal direction due to their contact with the obstacle W, the obstacle sensors 74, 74 are brought into contact with the protruding portion 70 (contact surface 73) or the inner surface of the bumper body 61 to thereby detect the withdrawal-direction movement, thus detecting the obstacle W from this movement detection. These obstacle sensors 74, 74 are placed, for example, in lower portion of the structure section 34, on both sides of the center line L, respectively, and in substantial line symmetry near the center line L, so that the obstacle sensors 74, 74 face the lower surface 32 (FIG. 9) and moreover face the inner surface of the bumper 15 on the lower side of the casing body 14. The obstacle sensors 74, 74 are positioned further up than the lower surface 32 of the main casing 12 and are housed inside the main casing 12. Also, each obstacle sensor 74 includes a contactor 77 pivotable in contact with the bumper 15 side, a sensor part 78 as a detection means body part (detector body part) for detecting pivot of the contactor 77, and a contactor spring 79 as a contactor biasing means (contactor biaser) for biasing the contactor 77 in a direction of its pivoting toward the bumper 15.

Each contactor 77 integrally includes a contactor body 81 formed into a substantially sectorial shape, and a contact portion 82 formed into a substantially sectorial shape coaxial with the contactor body 81. Then, at the central position of the sectorial shape of the contactor body 81 and the contact portion 82, the contactor 77 is pivotally held to a position near the outer rim portion of the casing body 14, where the center line L side of the contactor 77 is pivotable along the back-and-forth direction.

The contactor body 81 is a part located further in than the outer rim portion of the casing body 14 (on the counter bumper 15 side (counter bumper body 61 side)). The outer circumferential surface of the contactor body 81 is a circular-arc shaped sensing surface 84 facing the center line L side. The sensing surface 84 is positioned so as to extend along the back-and-forth direction, where a cutout portion 85 is formed at a rear end position. Preferably, the sensing surface is coated with black color, as an example, so as to reduce optical reflection.

The contact portion 82 is formed into a sectorial shape smaller in diameter than the contactor body 81 and is positioned protrusively outer than (on the bumper 15 (bumper body 61) side of) the outer rim portion of the casing body 14 so as to protrude forward of the contactor body 81, thus facing the bumper 15 (bumper body 61). A working surface 87 to be kept normally in contact with the contact surface 73 of the bumper 15 in the normal position of the bumper 15 is formed in a forward portion of the contact portion 82. The working surface 87 is a part forming a front edge portion of the contact portion 82, which extends forward and toward the center line L side along the tangential direction of pivot (pivotal axis) of the contactor 77 and which is substantially parallel to the contact surface 73 with the bumper 15 in the normal position. Accordingly, each working surface 87 in its planar direction has a vector component extending along the back-and-forth direction and a vector component extending along the left-and-right direction. In other words, each working surface 87 is sloped along directions crossing with the back-and-forth direction and the left-and-right direction, respectively. Also, the working surface 87 is placed so as to face toward the widthwise outer side, which is opposite to the center line L side. That is, each working surface 87 is placed on one side of the contactor 77 opposite to the sensing surface 84 side.

Each sensor part 78 is, for example, a noncontact type photointerrupter or the like, where a light-emitting portion 78*a* and a light-receiving portion 78*b* are placed in the casing body 14 so as to face each other with the sensing surface 84 of the contactor body of the contactor 77 interposed therebetween. Then, with the bumper 15 in the normal position, the cutout portion 85 is positioned between the light-emitting portion 78*a* and the light-receiving portion 78*b*, and pivoting of the contactor 77 causes the sensing surface to be interposed between the light-emitting portion 78*a* and the light-receiving portion 78*b*.

Each contactor spring 79 has one end portion held by the contactor 77 (contactor body 81) and the other end portion held by a spring receiving part 89 serving as a biasing-means receiving part (biaser receiving part) provided in the casing body 14. The spring receiving part 89 has a function as a pivot restricting part so that with the bumper 15 in the normal position, the spring receiving part 89 is in contact with the contactor body 81 so as to restrict the pivoting range of the contactor 77 in the forward (protruding) direction, which is a direction toward the bumper 15 side.

The extension part 62 is formed into a flat plate shape and, when inserted into the opening 35 so as to be in close contact with an underside portion of the upper surface 31, closes the upper surface of the gap between the bumper body 61 and the outer rim portion of the casing body 14. That is, as the bumper 15 is reciprocatively moved, the extension part 62 is moved in sliding contact along the underside portion of the upper surface 31.

The bumper-side pivotal support parts 63, 63 are placed apart from each other at substantially mutually line-symmetrical positions with respect to the center line L in the widthwise direction of the bumper 15 (main casing 12), and are formed so as to protrude vertically upward from a lower portion of the bumper body 61, with the upper part covered by the extension part 62. Then, the bumper-side pivotal support parts 63, 63 and the pivotal support parts 51, 51 of the structure section 34 are coupled with each other, respectively.

The bumper-side bias receiving part 64 is a part which receives and holds the fore end portion of the coil spring 55 and which is placed at such a position as to overlap with the widthwise center line L of the bumper body 61 (main casing 12 (bumper 15)), i.e., at a widthwise center portion of the bumper body 61 (main casing 12 (bumper 15)). Accordingly, with the bumper 15 in the normal position, the coil spring 55 is held in such a linear state as to extend along the back-and-forth direction with the center line L as a center axis.

The side levers 65, which are intended to support the bumper 15 against contact (collision) of the obstacle W from the side, are placed in the inner surfaces of both end portions (both side portions), respectively, of the bumper body 61 facing the casing body 14 as shown in FIGS. 2 to 4 and FIG. 6. Each of the side levers 65 includes a lever body 91 pivotably supported by the bumper body 61, and a coil spring 92 as a lever biasing means (lever biaser) for biasing the lever body 91 toward the protruding direction.

The lever body 91 has its frontal side pivotally supported by the bumper body 61 so as to be pivotable along the left-and-right direction. A tip end portion of the lever body 91, which is formed into a semicolumnar shape so as to be fitted to a receiving portion 93 recessed in a circular-arc shape in cross section on both sides of the casing body 14, restricts the position of the bumper 15 in the back-and-forth direction against the casing body 14 by being fitted to the receiving portion 93. Also, with the bumper 15 in the normal position, the lever body 91 is in contact with a stopper part 94 provided in the bumper body 61, thereby being restricted from pivoting in the direction of protruding from the bumper body 61.

Each of the link mechanisms 16 is composed of the pivotal support part 51, the bumper-side pivotal support part 63, and a coupling member 95 for coupling the pivotal support part 51 and the bumper-side pivotal support part 63 to each other. The link mechanisms 16 connect the bumper 15 to the casing body 14 so that the bumper 15 can be moved relative thereto in the horizontal direction.

With regard to the coupling member 95, its fore end portion is pivotally held by the bumper-side pivotal support part 63 so as to be circumferentially pivotable, while an elongate hole 96 into which the pivotal support part 51 is inserted so as to be circumferentially pivotable and sliding-contactable is formed on the rear end side. Then, each coupling member 95 is pivoted relative to the bumper-side pivotal support part 63 (bumper 15) while the pivotal support part 51 is moved in sliding contact along the elongate hole 96 and moreover pivoted within the elongate hole 96, thus allowing the bumper 15 to be movable horizontally relative to the casing body 14. That is, the casing body 14, the bumper and the coupling members 95, 95 constitute a link unit.

Then, the center lines L of the bumper 15 and the casing body 14 are centered so as to be substantially coincident with each other by the link mechanisms 16, the coil spring 55 and the side levers 65, in which state the bumper 15 is normally biased in such a direction as to be maintained in the normal position.

The electric blower 21 is housed in the main casing 12 at a position, for example, between the driving wheels 23, 23. The suction side of the electric blower 21 is connected airtightly to the dust collector unit 22.

The dust collector unit 22 internally stores dust and dirt sucked through the suction port 42 by drive of the electric blower 21. In this embodiment, the dust collector unit 22 is provided as a dust collecting box removably fittable to the main casing 12.

The driving wheels 23, 23 make it possible for the main casing 12 to run (autonomously travel) on a surface to be cleaned, that is, the driving wheels 23, 23 are for traveling use and are formed into a disc shape having a rotational axis along the horizontal direction (widthwise direction), where the driving wheels 23, 23 are placed apart from each other in the widthwise direction at positions near the back-and-forth direction center in the lower part of the main casing 12. Then, these driving wheels 23, 23 are driven into rotation via motors 98, 98 (FIG. 8) serving as driving means (driving parts).

These motors 98, 98 are connected to the driving wheels 23, 23, respectively, via unshown gear boxes as drive transmission means (drive transmission parts), where the driving wheels 23, 23 can be driven independently of each other. Then, the motors 98, 98 are biased by an unshown suspending means (suspending part (suspension)) integrally with the driving wheels 23, 23 and the gear boxes in such a direction as to be protruded downward from the lower surface 32 of the main casing 12, where gripping force of the driving wheels 23, 23 to the surface to be cleaned is ensured by the biasing.

The driven wheels 24 (FIG. 9) are placed so as to be rotatable, as required, at such positions that the weight of the vacuum cleaner 11 can be supported with a good balance in the lower surface 32 of the main casing in cooperation with the driving wheels 23, 23. In particular, a driven wheel 24 located at a position in frontal portion and in a substantial widthwise center portion of the lower surface 32 of the main casing 12 serves as a swing wheel 99 which is attached to the lower surface 32 so as to be swingable in parallel to the surface to be cleaned.

The distance measuring sensors 25 are noncontact type sensors such as ultrasonic sensors or infrared sensors. The distance measuring sensors 25 are located, for example, on a rearward outer circumferential surface 33 of the casing body 14 of the main casing 12 and on the bumper 15 (bumper body 61) and are each enabled to detect the presence or absence of any obstacle (wall portion) W or the like located outside the main casing 12 as well as the distance of the obstacle or the like to the main casing 12.

The side brushes 26, 26 are intended to scrape together and clean up dust and dirt located on both sides of the suction port 42, to which the suction port 42 does not reach, particularly outward of the outer frame (outer circumferential surface) of the main casing 12 or forward of the driving wheels 23, 23 such as in wall proximities. The side brushes 26, 26 are placed at positions of the brush fitting portions 68, 68 of the bumper 15, i.e., at positions on widthwise both sides of the main casing 12, in this embodiment on oblique both sides of the main casing 12 forward of its center portion in the back-and-forth direction (45° left-and-right forward direction of the main casing 12). While these side brushes 26, 26 are in a normal position with no load applied by contact with the obstacle W or the like, each side brush 26 has its tip end side protruding outward from the outer frame of the main casing 12 (bumper 15) and its base end side located inside the outer frame of the main casing 12 (bumper 15). Then, each of the side brushes 26, 26 includes a brush body 101 as a cleaning-unit body enabled to radially go out relative to the outer frame of the main casing 12 along the radial direction of the main casing 12, a brush biasing spring 102 as a cleaning-unit biasing means (cleaning-unit biaser) for biasing the brush body 101 in a direction of protruding from the outer frame (outer circumferential surface) of the main casing 12, a cleaner member 103 such as a bristle brush rotatably placed in a lower part of the brush body 101 facing the surface to be cleaned, and a swing motor 104 as a swing driving means (swing driving part) for turning the cleaner member 103.

The brush body 101 has its tip end side formed into a shape extending along a circular arc as an example, and in this embodiment into an elliptical shape. This brush body 101 (side brush 26) is so designed that the brush body 101, when brought into contact with an obstacle W or the like, is moved within a specified moving range in the withdrawal direction toward the main casing 12 side against the biasing of the brush biasing spring 102. As this moving range of the brush body 101 (side brush 26), there are set a first moving range over which the brush body 101 can be reciprocatively moved without interlocking with the bumper 15, the first moving range extending from a position where the brush body 101 is protruded outward from the outer circumferential surface of the bumper body 61 of the bumper 15 forming the outer frame (outer circumferential surface) of the main casing 12 to a position where the brush body 101 becomes substantially flush with the outer circumferential surface of the bumper body 61 of the bumper 15, as well as a second moving range over which the brush body 101 can be reciprocatively moved while integrally interlocking with the bumper 15 as it is maintained in the state of being substantially flush with the outer circumferential surface of the bumper body 61 of the bumper 15. That is, inside the brush body 101, a brush contact portion 106 that is a circular arc-shaped cleaning-unit contact portion having its both ends contactable with the contact portions 69, 69 of the bumper 15 is formed. In the first moving range, the brush contact portion 106 is apart from the contact portions 69, 69. With the brush body 101 (side brush 26) moved to a boundary position between the first moving range and the second moving range, the brush contact portion 106 is reciprocatively moved integrally with the bumper 15 as it is in contact with the contact portions 69, 69. In this embodiment, the first moving range is set wider than the second moving range, where the first moving range is set to a stroke of 10 mm and the second moving range is set to a stroke of 5 mm, as an example.

The brush biasing spring 102 is a coil spring as an example, of which one end side is held by the swing motor 104 and the other end side is held by a spring receiving part 108 serving as a cleaning-unit biasing means receiving part (cleaning-unit biaser receiving part) provided in the casing body 14 so that the brush body 101 is biased linearly along the radial direction of the main casing 12.

Each swing motor 104 is integrally attached on the base end side of the brush body 101 so that the cleaner member 103 is rotated in parallel to the surface to be cleaned, i.e., swung. In this embodiment, the swing motors 104, 104 swing the cleaner members 103, 103 in mutually opposite directions so that dust and dirt located on both sides of the main casing 12 are scraped together toward the widthwise center side of the main casing 12. That is, the swing motor 104 of the side brush 26 located on the left side swings the cleaner member 103 clockwise (right-handedly) while the swing motor 104 of the side brush 26 located on the right side swings the cleaner member 103 counterclockwise (left-handedly).

Then, the control unit 27 includes clocking means (clocking part) such as a timer, storage means (storage part) such as a memory, and a control unit main part such as a microcomputer. The control unit 27 is electrically connected to the electric blower 21, the distance measuring sensors 25, the communication part 28, the brush motor 44, the obstacle sensors 74, 74, the motors 98, 98, the swing motors 104, 104 and the like and is enabled to control the drive of the driving wheels 23, 23 via the motors 98, 98 based on detection results by the distance measuring sensors 25 and the obstacle sensors 74, 74 so that the main casing 12 (vacuum cleaner 11) is autonomously traveled while avoiding any obstacle W, by which driving of the electric blower 21, the brush motor 44, the swing motors 104 and the like is controlled to make the vacuum cleaner 11 do the cleaning.

The communication part 28, which is placed at the widthwise center portion of the extension part 62 of the bumper 15, is reciprocatively moved integrally with the bumper 15. Accordingly, a circular arc-shaped cut-out recessed portion 109 for avoiding interference with the communication part 28 is formed as a notch at a widthwise central portion of the fore end portion of the upper surface 31 in the casing body 14.

The secondary battery 29 (FIG. 8) feeds electric power to the control unit 27, the electric blower 21, the distance measuring sensors 25, the communication part 28, the brush motor 44, the motors 98, 98, the swing motors 104, 104 and the like. The secondary battery 29 is placed at a position between the driving wheels 23, 23 behind the swing wheel as an example. Then, the secondary battery 29, which is electrically connected with a charging terminal located at the lower surface 32 of the main casing 12, can be charged by the charging terminal being connected to an unshown specified charging table provided at a specified position indoors (in a room) as an example.

Next, operation of the above-described embodiment will be described.

When the vacuum cleaner 11 is set on the surface to be cleaned, the driving wheels 23, 23 are brought into contact with the surface to be cleaned, where the driving wheels 23, 23 sink into the main casing 12 together with the gear boxes by the self weight of the vacuum cleaner 11 against the biasing of suspension means (suspension part) to such a position that the driven wheel 24 (swing wheel 99) is brought into contact with the surface to be cleaned, with a result that a specified gap is formed between the suction port 42 and the surface to be cleaned. Then, when it comes to a specified time previously set to the control unit 27 as an example, the vacuum cleaner 11 drives the electric blower 21, starting with cleaning of the charging table as an example. In addition, the start position of the cleaning may be set to an arbitrary one such as a traveling start position of the vacuum cleaner 11 or a doorway of the room.

In this vacuum cleaner 11, the control unit 27 drives the electric blower 21 and moreover the motors 98, 98 detect the distance to the obstacle W or the like or contact with the obstacle W via the distance measuring sensors 25 and the obstacle sensors 74, thereby monitoring the position and traveling state of the vacuum cleaner 11. Thus, while avoiding the obstacle W in response to detection of the sensors 25, 74, the vacuum cleaner 11 travels on the surface to be cleaned to clean the surface to be cleaned by operating the side brushes 26, 26 and the rotary brush 43 as required.

Figure 2:
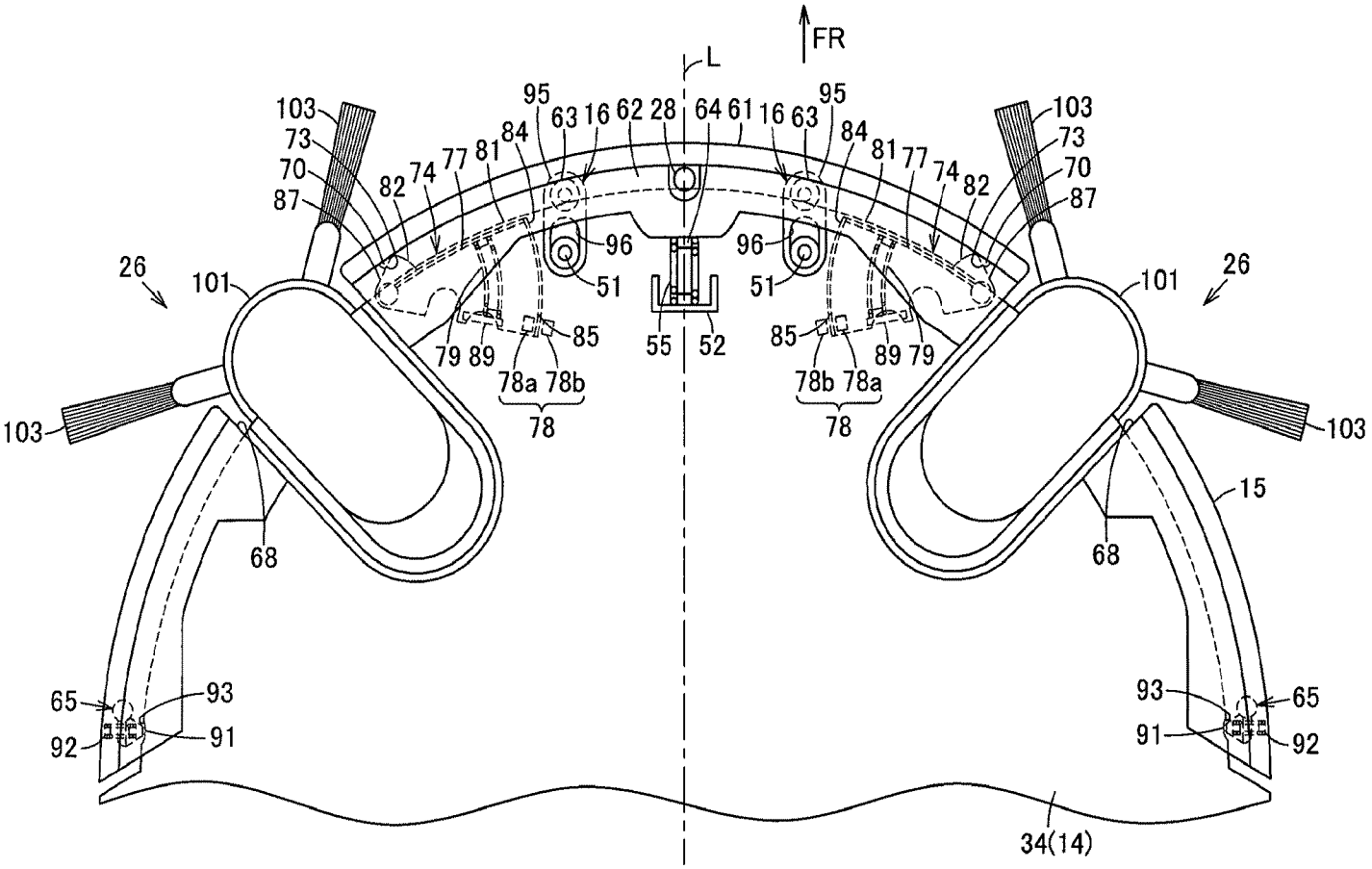
FIG. 2 is a plan view schematically showing part of a state in which the bumper of the vacuum cleaner is set in a normal position.

For example, while the bumper 15 is in the normal position shown in FIG. 2, the obstacle sensors 74, 74 each operate in a way that with the cutout portion 85 positioned between the light-emitting portion 78*a* and the light-receiving portion 78*b*, light emitted from the light-emitting portion 78*a* can be received by the light-receiving portion 78*b*.

Figure 3:
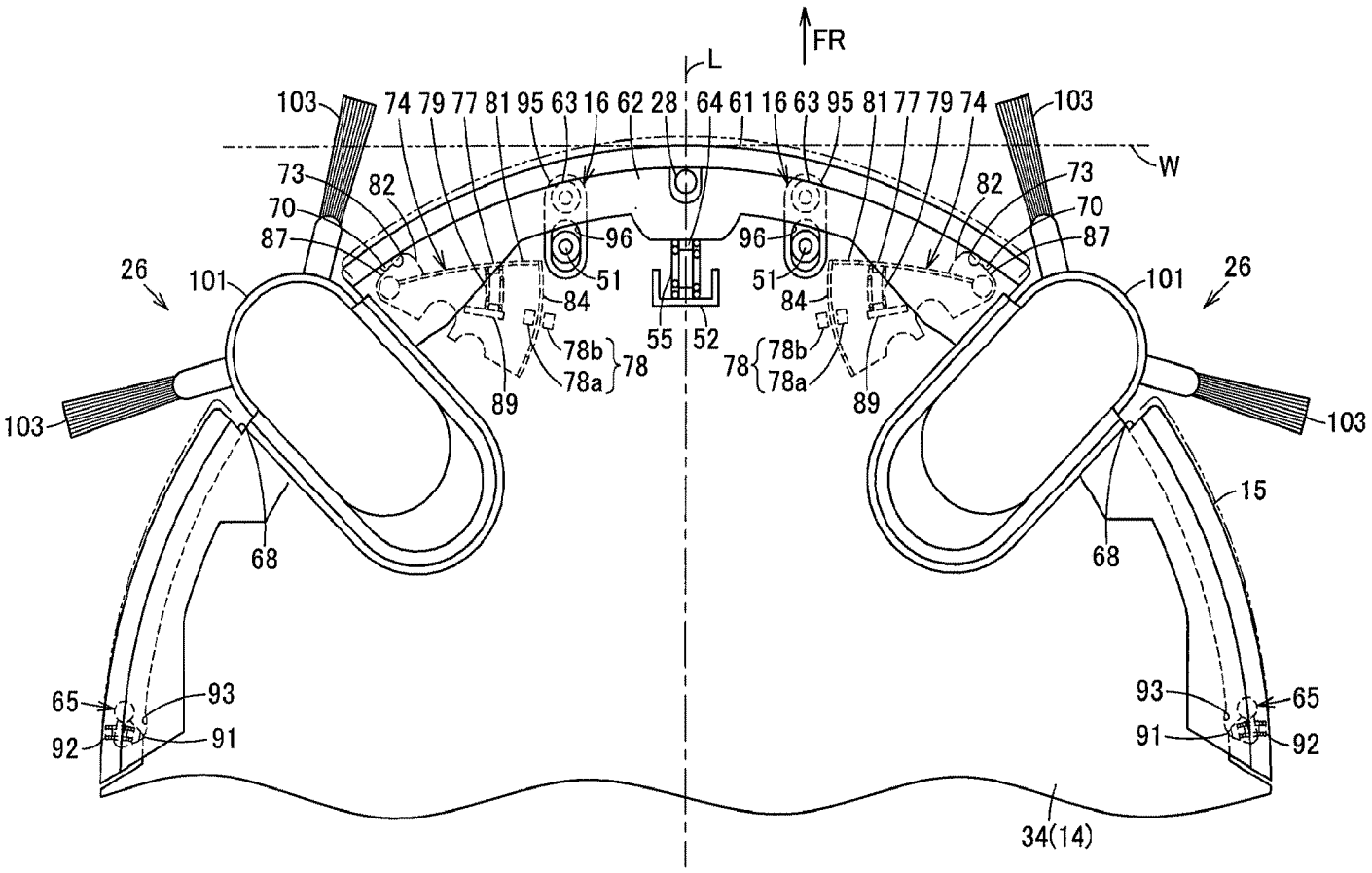
FIG. 3 is a plan view schematically showing part of a state in which an obstacle has come from the front into contact with the bumper of the vacuum cleaner.

Meanwhile, with the obstacle W in contact with frontal portion of the bumper 15 as shown in FIG. 3, the bumper 15 is relatively moved rearward of the casing body 14 against the biasing of the coil spring 55, i.e., in a direction opposite to the biasing direction of the coil spring 55. In this case, each pivotal support part 51 of the casing body 14 is moved in sliding contact relative to the elongate hole 96 of the coupling member 95 in the link mechanism 16 and moreover the lever body 91 of the side lever 65 is pivoted outward against the biasing of the coil spring 92. Then, each protruding portion 70 is moved rearward integrally with the rearward movement of the bumper 15, by which the contact surface 73 of the protruding portion 70 pushes the working surface 87 of the contactor 77 of each obstacle sensor 74 rearward, so that each contactor 77 is pivoted rearward against the biasing of the contactor spring 79. That is, a rearward movement of the bumper 15 is transformed into rearward pivoting operation of each contactor 77. Then, in the obstacle sensor 74, as each contactor 77 is pivoted rearward, the sensing surface 84 is moved to between the light-emitting portion 78*a* and the light-receiving portion 78*b* of the sensor part 78, so that the sensing surface 84 interrupts light reception of emission from the light-emitting portion 78*a* by the light-receiving portion 78*b*. Accordingly, that the light reception by the light-receiving portion 78*b* has been interrupted is detected by an output from the light-receiving portion 78*b*, by which pivoting of the contactor 77, i.e., rearward movement of the bumper 15 is detected by each sensor part 78. Thus, contact of the obstacle W against the bumper 15, that is, presence of the obstacle W, is detected indirectly.

Figure 4:
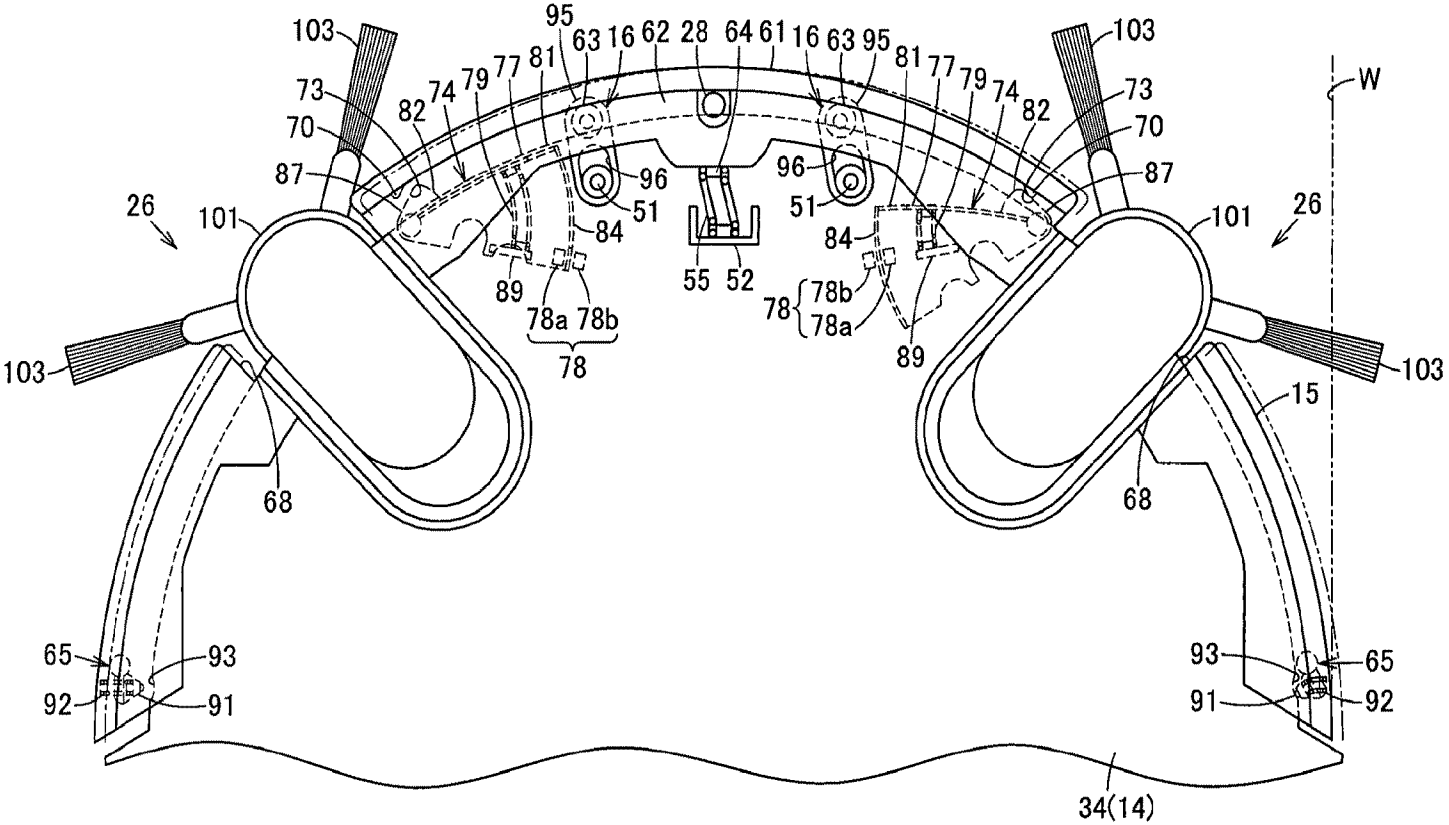
FIG. 4 is a plan view schematically showing part of a state in which an obstacle has come from the side into contact with the bumper of the vacuum cleaner.

Similarly, as the obstacle W has come into contact with one side portion (right side portion) of the bumper 15 for example, as shown in FIG. 4, the bumper 15 is moved toward the other side (toward the left side) relative to the casing body 14, i.e., in a direction crossing (orthogonally intersecting) with the biasing direction of the coil spring 55 against the biasing of the coil spring 92. In this case, with regard to the coupling member 95 of the link mechanism 16, since its frontal portion pivotally supported by the bumper-side pivotal support part 63 is shifted toward the other side (toward the left side) relative to its rear portion in which the pivotal support part 51 of the casing body 14 is inserted through the elongate hole 96, those portions are pivoted obliquely while being maintained in parallel to each other, and moreover the lever body 91 of the side lever 65 located at one side portion (right side portion) on the obstacle W side is pivoted outward against the biasing of the coil spring 92. Then, as the protruding portion 70 is moved toward the other side along with the movement of the bumper 15 toward the other side, it follows, because the contact surface 73 of the protruding portion 70 and the working surface 87 of the contactor 77 have inclined shapes respectively relative to the back-and-forth direction and the left-and-right direction, that the obstacle sensor 74 located on one side (right side), which is the side closer to the obstacle W, operates so that sideward pressing of the working surface of the contactor 77 by the contact surface 73 is transformed into rearward pressing force due to the inclination of the working surface 87, causing the contactor 77 to be pushed rearward. Thus, as the contactor 77 is pivoted rearward against the biasing of the contactor spring 79, the obstacle sensor 74 located on the other side (left side), which is the side opposite to the obstacle W side, goes that the contact surface 73 does not press the working surface 87 of the contactor 77, thus the contactor 77 does not pivot. That is, at only the obstacle sensor 74 located on the obstacle W side (right side), a sideward movement of the bumper 15 is transformed into rearward pivoting operation of the contactor 77. As a result of this, at the sensor part 78 of the obstacle sensor 74 located on the obstacle W side (on the right side), the light reception of emission from the light-emitting portion 78*a* by the light-receiving portion 78*b* is interrupted by the sensing surface 84 moved to between the light-emitting portion 78*a* and the light-receiving portion 78*b*. Therefore, as in the above-described case, that the light reception by the light-receiving portion 78*b* has been interrupted is detected by an output from the light-receiving portion 78*b*, by which pivoting of the contactor 77, i.e., a sideward movement of the bumper 15 is detected, allowing contact of the obstacle W with the bumper 15 to be detected indirectly.

Further, with the obstacle W in contact with a frontal side portion of the bumper 15, an operation resulting from combining together the above-described operations of FIGS. 3 and 4 is involved, that is, the bumper 15 is moved rearward and obliquely relative to the casing body 14. As a result, the working surface 87 of the contactor 77 of the obstacle sensor 74 located on the obstacle W side is pushed by the contact surface 73 of the protruding portion 70 of the bumper 15, and moreover the working surface 87 of the contactor 77 of the obstacle sensor 74 located on the side opposite to the obstacle W side is separated apart from the contact surface 73 of the protruding portion 70 and pushed by the inner surface of the bumper 15, so that pivoting of these contactors 77, i.e. a movement of the bumper 15, is detected similarly, allowing contact of the obstacle W with the bumper 15 to be detected indirectly.

Figure 5A:
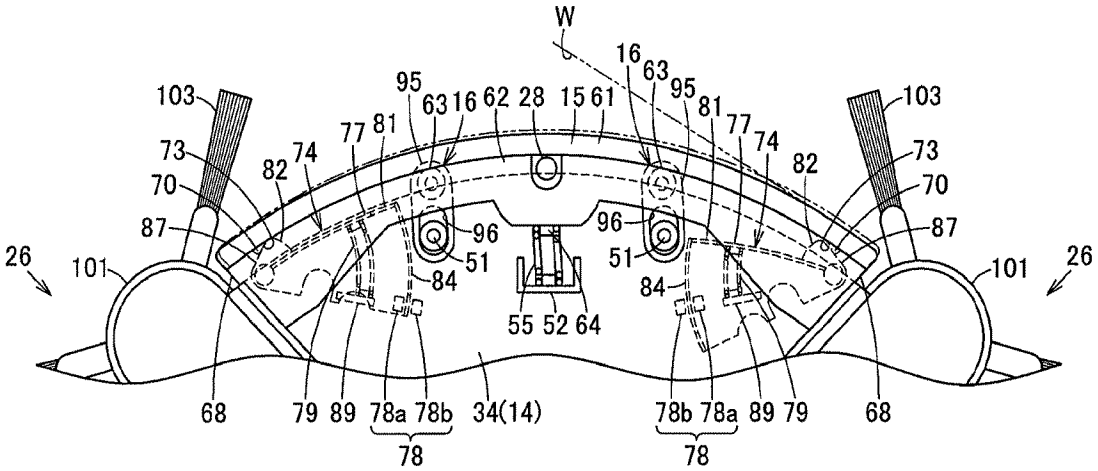
FIGS. 5A and 5B are plan views schematically showing part of a state in which an obstacle has come from an oblique front into contact with the bumper of the vacuum cleaner in order of FIG. 5A and FIG. 5B.
Figure 5B:
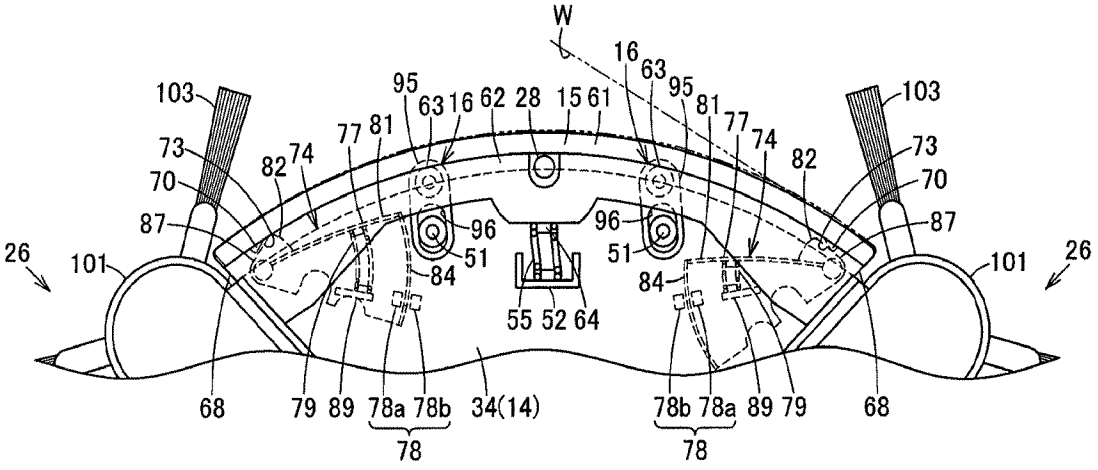
Figure 6:
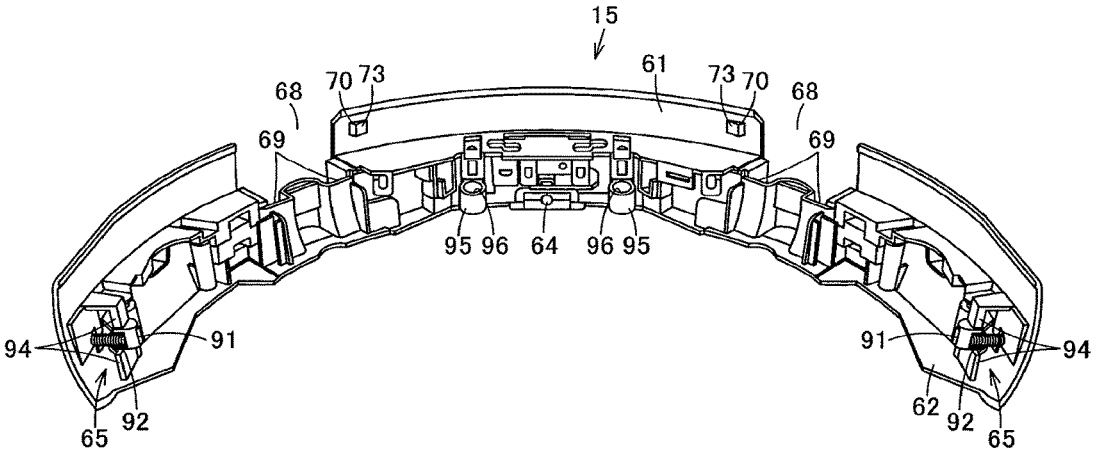
FIG. 6 is a perspective view showing the bumper of the vacuum cleaner from below.

Therefore, as shown in FIGS. 3 and 4 as well as FIGS. 5A and 5B with regard to the obstacle sensors 74, as the direction of the obstacle W in contact with the bumper 15 moves more and more from a frontal to a sideward portion, detection by the obstacle sensor 74 located on the obstacle W side becomes faster and faster than detection by the obstacle sensor 74 located on its opposite side, so that when the obstacle W comes into contact with the side portion of the bumper 15, detection is effected only by the obstacle sensor 74 located on the obstacle W side, and not by the obstacle sensor 74 located on the opposite side. Accordingly, the obstacle sensors 74, 74 are enabled to detect the direction of the obstacle W based on the presence or absence of their individual detection and the timing of detection (time difference of detection).

In addition, the bumper 15 having come into contact with the obstacle W is maintained in contact with the obstacle W by biasing of the coil spring 55. When the vacuum cleaner 11 (main casing 12) moves to a position out of contact with the obstacle W, the bumper 15 returns to the original normal position.

Figure 1A:
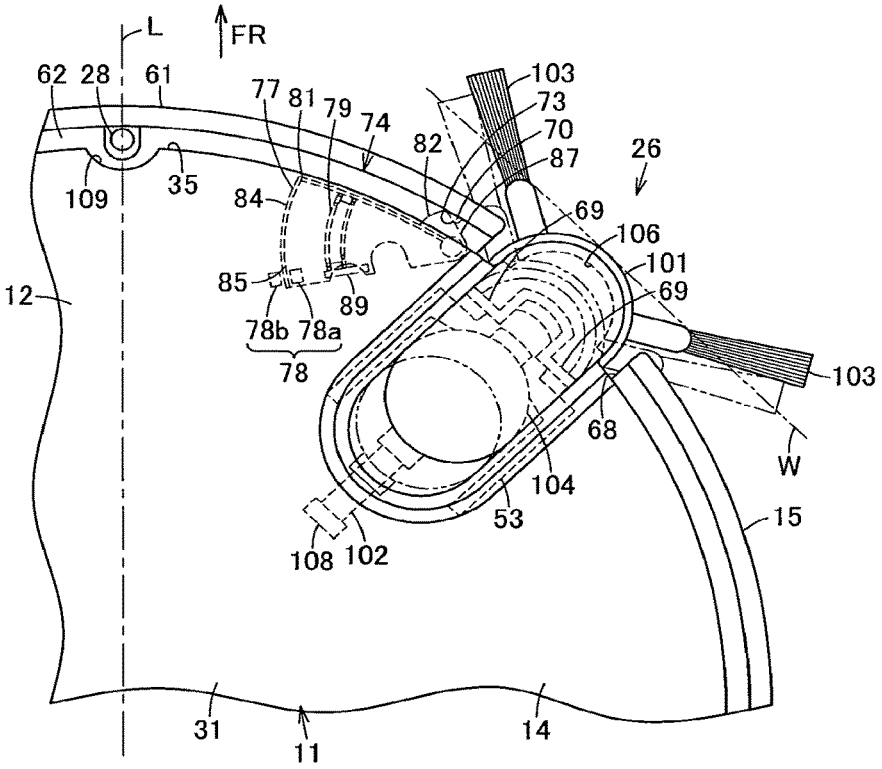
FIG. 1A is a plan view schematically showing a state in which a bumper of a vacuum cleaner according to an embodiment moves in a first moving range and FIG. 1B is a plan view schematically showing a state in which the bumper of the vacuum cleaner moves in a second moving range.
Figure 1B:
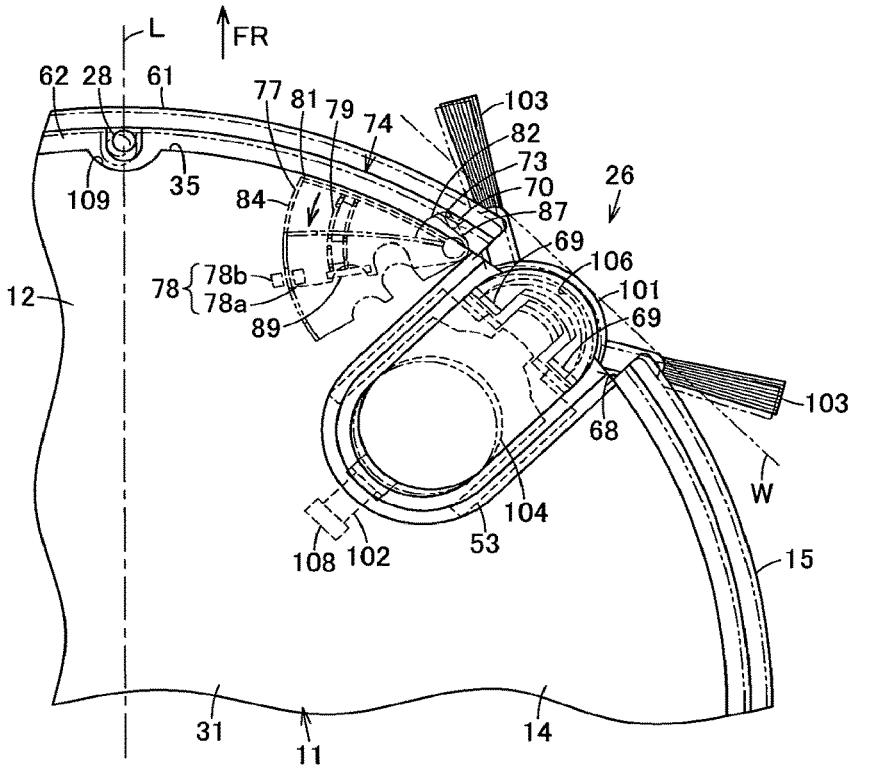

Also, when the obstacle W has come into contact with the side brush 26 protruding outward from the outer frame of the bumper 15 (main casing 12), i.e., from the outer surface of the bumper body 61 of the bumper 15, the side brush 26 is moved, as shown in FIGS. 1A and 1B, into the brush fitting portion 68 toward the center side of the main casing 12 (toward the withdrawal direction) along the guide portion 53 against the biasing of the brush biasing spring 102. In this case, the side brush 26 is reciprocatively moved independently of (without interlocking with) the bumper 15 within the first moving range, i.e., from outward of the outer frame of the bumper 15 (main casing 12) to a position where the enveloping surface of this outer frame and the tip end side of the side brush 26 become substantially flush with each other (FIG. 1A). In addition, because of the arrangement that each side brush 26 has its tip end side formed along a circular arc, for example during swinging of the vacuum cleaner 11 (main casing 12), even when the side brush 26 has come into contact with the obstacle W along a tangential direction of the swinging (tangential direction of the main casing 12), external force applied due to the contact is transformed into that of the withdrawal direction, so that the side brush 26 can be moved in the withdrawal direction toward the main casing 12 side. Also, within the second moving range, i.e., from the position where the tip end side of the side brush 26 becomes substantially flush with the enveloping surface of the outer frame of the bumper 15 (main casing 12) to another position inward thereof, the brush contact portion 106 comes into contact with the contact portions 69, 69 of the bumper 15, thus each side brush 26 interlocks with the bumper 15 to be reciprocatively moved integrally therewith (FIG. 1B). Accordingly, within the second moving range where the side brush 26 has been moved over a specified extent in the withdrawal direction, each side brush 26 acts as part of the bumper 15. That is, when each side brush 26 has come into contact with the obstacle W within the second moving range, pivoting of the contactor 77 is detected by each obstacle sensor 74 as with the above-described action of the bumper 15 shown in FIGS. 3 FIG. 4, FIG. 5A and FIG. 5B, so that the obstacle W is detected indirectly.

In addition, each side brush 26 having come into contact with the obstacle W is maintained in contact with the obstacle W by biasing of the brush biasing spring 102. When the vacuum cleaner 11 (main casing 12) moves to a position out of contact with the obstacle W, the side brush 26 returns to the original normal position where the tip end side of the side brush 26 is protruded outward of the outer frame of the bumper 15 (main casing 12).

As a result of this, the vacuum cleaner 11 of this embodiment is enabled to detect, by the obstacle sensors 74, any obstacle W in contact with a substantial frontal-side half of the outer frame of the main casing 12.

Moreover, the cleaner member 103 of each side brush 26 protruding outward of the outer frame of the main casing 12 is elastically bent by contact with the obstacle W, thus not obstructing the contact of the side brush 26 and the bumper 15 with the obstacle W.

Upon detection of an obstacle W, the vacuum cleaner 11 takes action so as to avoid the obstacle W. For example, the vacuum cleaner 11 travels in a separating-apart direction, i.e. rearward, relative to the obstacle W to such an extent that the side brush 26 or the bumper 15 does not collide therewith (the obstacle sensor 74 does not detect the obstacle W), or swings at the detection position so as to change the forwarding direction to one other than the direction approaching the obstacle W.

Then, the vacuum cleaner 11 sucks in, together with air, dust and dirt located on the confronting surface to be cleaned or dust and dirt collected by the side brushes 26, 26 through the suction port 42 to which a negative pressure generated by drive of the electric blower 21 is applied. Also, the rotary brush 43 scrapes up dust and dirt on the surface to be cleaned through the suction port 42.

Dust and dirt sucked through the suction port 42 or dust and dirt scraped up to the suction port 42 is led and collected to the dust collector unit 22. Moreover, air from which dust and dirt has been separated is sucked into the electric blower 21, cooling the electric blower 21 and thereafter making exhaust air, which is discharged outside the main casing 12 through the exhaust ports 41.

When it is decided that the cleaning over the cleaning region has ended, the control unit 27 makes the vacuum cleaner 11 autonomously travel to the position of the charging table. Then, the control unit 27 stops the electric blower 21 or the like and moreover stops the motors 98, 98 with the charging terminal (physically and electrically) connected to the charging table, by which the operation is ended and the secondary battery 29 is charged.

According to the embodiment described hereinabove, the vacuum cleaner 11 includes the obstacle sensor 74, which detects an obstacle by detecting a movement of the side brush 26 in a withdrawal direction due to its contact with the obstacle W, the side brush 26 being provided reciprocatively movable in one direction of protruding from the outer frame of the main casing 12 and another withdrawal direction opposite to the one direction. As a result of this, while dust and dirt located outside of the outer frame of the main casing 12 can securely be cleaned by the side brushes 26 protruding from the outer frame of the main casing 12, any obstacle W at the positions of the side brushes 26 can be detected. Therefore, the vacuum cleaner 11 is enabled to autonomously travel while avoiding any obstacle W without catching on the obstacle W even at the positions of the side brushes 26.

Further, since the side brushes 26 are moved so as to withdraw toward the outer frame of the main casing 12 upon contact with the obstacle W, it is less likely for the side brushes 26 to catch on the obstacle W, thus less likely for them to be obstructed from autonomous traveling.

Still further, the obstacle sensor 74 is enabled to detect any obstacle W by detecting a movement of the side brush 26 in the withdrawal direction due to contact with the obstacle W from the position to which the side brush 26 has been moved to a specified extent in the withdrawal direction (second moving range). Therefore, in a duration until the side brush 26 comes to a position of having come to a specified movement extent in the withdrawal direction (first moving range), the main casing 12 (vacuum cleaner 11) is blocked from autonomously traveling to avoid the obstacle W, but the side brush 26 cleans up dust and dirt on the surface to be cleaned near the obstacle W while remaining in contact with the obstacle W. Therefore, dust and dirt near the obstacle W located outside the outer frame of the main casing 12 can be cleaned more effectively.

Moreover, the obstacle sensor 74 detects any obstacle W by detecting a movement of the bumper 15 in the withdrawal direction due to either contact of the bumper 15, which is provided reciprocatively movable, with the obstacle W or a movement of the side brush 26 within the second moving range in which the side brush 26 is moved in the withdrawal direction while interlocking with the bumper 15. Therefore, it is possible to detect the obstacle W over a wider range by utilizing the wideness of the bumper 15 and moreover to detect a movement of the side brush 26 in the withdrawal direction by the obstacle sensor 74 that detects a movement of the bumper 15. Thus, constitutional communization for the vacuum cleaner can be implemented, allowing a simplification of the constitution to be achieved.

In addition, in the above embodiment, only one side brush 26 may be provided, either on the left or right of the main casing 12.

Also, although the obstacle sensor 74 is provided as an object for detecting the obstacle W via a movement of the bumper 15, obstacle detection means (obstacle detection unit) for exclusive use of detecting a movement of the side brush 26 in the withdrawal direction may be provided.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. A vacuum cleaner comprising:

a main casing;

a driving wheel for enabling the main casing to travel;

a cleaning unit which is provided so as to be reciprocatively movable in a direction of protruding from an outer frame of the main casing and its opposite direction and which is enabled to clean dust and dirt located outside the outer frame of the main casing;

an obstacle detection unit for detecting an obstacle by detecting a movement of the cleaning unit in the opposite direction due to its contact with the obstacle; and a control unit for controlling drive of the driving wheel based on detection of an obstacle by the obstacle detection unit to make the main casing travel autonomously, wherein the main casing includes a bumper provided as reciprocatively movable, the cleaning unit has a first moving range over which the cleaning unit is reciprocatively moved without interlocking with the bumper, and a second moving range over which the cleaning unit is reciprocatively moved while interlocking with the bumper, and the obstacle detection unit is enabled to detect an obstacle by detecting a movement of the bumper due to either contact of the bumper with the obstacle or a movement of the cleaning unit in the opposite direction within the second moving range.

2. The vacuum cleaner as claimed in claim 1, wherein the obstacle detection unit is enabled to detect an obstacle by detecting a movement of the cleaning unit in the opposite direction clue to its contact with the obstacle from a position to which the cleaning unit has been moved to a specified extent in the opposite direction.

* * * * *